United States Patent [19]

Yamada et al.

[11] 4,161,128

[45] Jul. 17, 1979

[54] ELECTRONIC MUSICAL INSTRUMENT

[75] Inventors: Shigeru Yamada; Eiichiro Aoki, both of Hamamatsu, Japan

[73] Assignee: Nippon Gakki Seizo Kabushiki Kaisha, Hamamatsu, Japan

[21] Appl. No.: 859,042

[22] Filed: Dec. 9, 1977

[30] Foreign Application Priority Data

Dec. 13, 1976 [JP] Japan ..... 51-149945

[51] Int. Cl.[2] ..... G10H 1/02

[52] U.S. Cl. ..... 84/1.26; 84/1.13

[58] Field of Search ..... 84/1.03, 1.13, 1.24, 84/1.26, 1.27; 307/232, 295; 361/76

[56] References Cited

U.S. PATENT DOCUMENTS

| | | | |
|---|---|---|---|
| 3,590,276 | 6/1971 | Watson | 307/295 |
| 3,902,128 | 8/1975 | Perszyk | 307/295 |
| 4,011,503 | 3/1977 | Ferrara | 307/232 |
| 4,079,650 | 3/1978 | Deutsch et al. | 84/1.26 |

*Primary Examiner*—Gene Z. Rubinson

*Attorney, Agent, or Firm*—Spensley, Horn, Jubas & Lubitz

[57] ABSTRACT

An electronic musical instrument comprises a circuit for generating a stepwise envelope waveform which modulates a musical tone waveform signal, a detecting circuit for detecting the phase of the musical tone waveform signal where the amplitude of the musical tone waveform signal becomes the zero level, and a control circuit for bringing the amplitude of the envelope waveform to be at the zero level in synchronization with the detection of that phase of the tone signal by the detecting circuit if generation of the envelope waveform is to be finished, thereby to eliminate the generation of click sounds.

7 Claims, 21 Drawing Figures

ELECTRONIC MUSICAL INSTRUMENT

BACKGROUND OF THE INVENTION

This invention relates to electronic musical instruments, and more particularly to a control effected in ending the generation of a musical tone amplitude envelope in an electronic musical instrument.

In generating an envelope waveform with a digital type electronic musical instrument, the amplitudes of the envelope waveform at sequential sampling points are stored in an envelope memory, and a counter controlling a memory reading operation is driven with the aid of predetermined clock pulses so as to successively advancing the addresses to be read out of the memory storing the sampling point amplitudes. Accordingly, the envelope waveform is generated stepwise. The modulation of the amplitude of a musical tone waveform (or a tone source waveform) is effected in accordance with the shape of the envelope waveform.

The envelope waveform is in the form of steps, as described above. Therefore, when the generation of the envelope waveform is finished at the last step thereof, the level of the envelope waveform as shown in FIG. 1(*a*) is lowered abruptly to the zero level from the level L of the last step. If the instant when the last step of the envelope waveform falls to the zero level corresponds to such a phase of the musical tone waveform signal that exhibits its maximum or nearly maximum amplitude, the amplitude of the musical tone waveform signal is lowered abruptly to the zero level. As a result, upon termination of the tone production (or termination of the envelope form generation) a click sound is produced.

SUMMARY OF THE INVENTION

Accordingly, an object of this invention is to eliminate the above-described drawback accompanying a conventional digital type electronic musical instrument.

More specifically, an object of the invention is to provide an electronic musical instrument in which when an envelope waveform is generated in the form of steps, the amplitude of the envelope waveform is caused to fall to the zero level in coincidence with the time instant when a musical tone waveform signal modulated by the envelope waveform is the zero level in its amplitude.

According to this invention, in the electronic musical instrument no click sound is generated because the time instant when the amplitude of the envelope waveform is lowered to the zero level conicides with the time instant when the amplitude of the musical tone waveform signal has the zero level and, accordingly, the tone production can be smoothly completed.

In the electronic musical instrument according to the invention, when the last step of the envelope waveform takes place, the envelope amplitude value of this last step is held while the phase in which the amplitude of the musical tone waveform signal has the zero level in detected, and the envelope amplitude value of the last step having been held is lowered to the zero level in accordance with the detection operation.

The nature, utility and principle of the invention will be more clearly understood from the following detailed description and the appended claims when read in conjunction with the accompanying drawings, in which like parts are designated by like reference numerals.

DETAILED DESCRIPTION OF THE INVENTION

Figure 2:
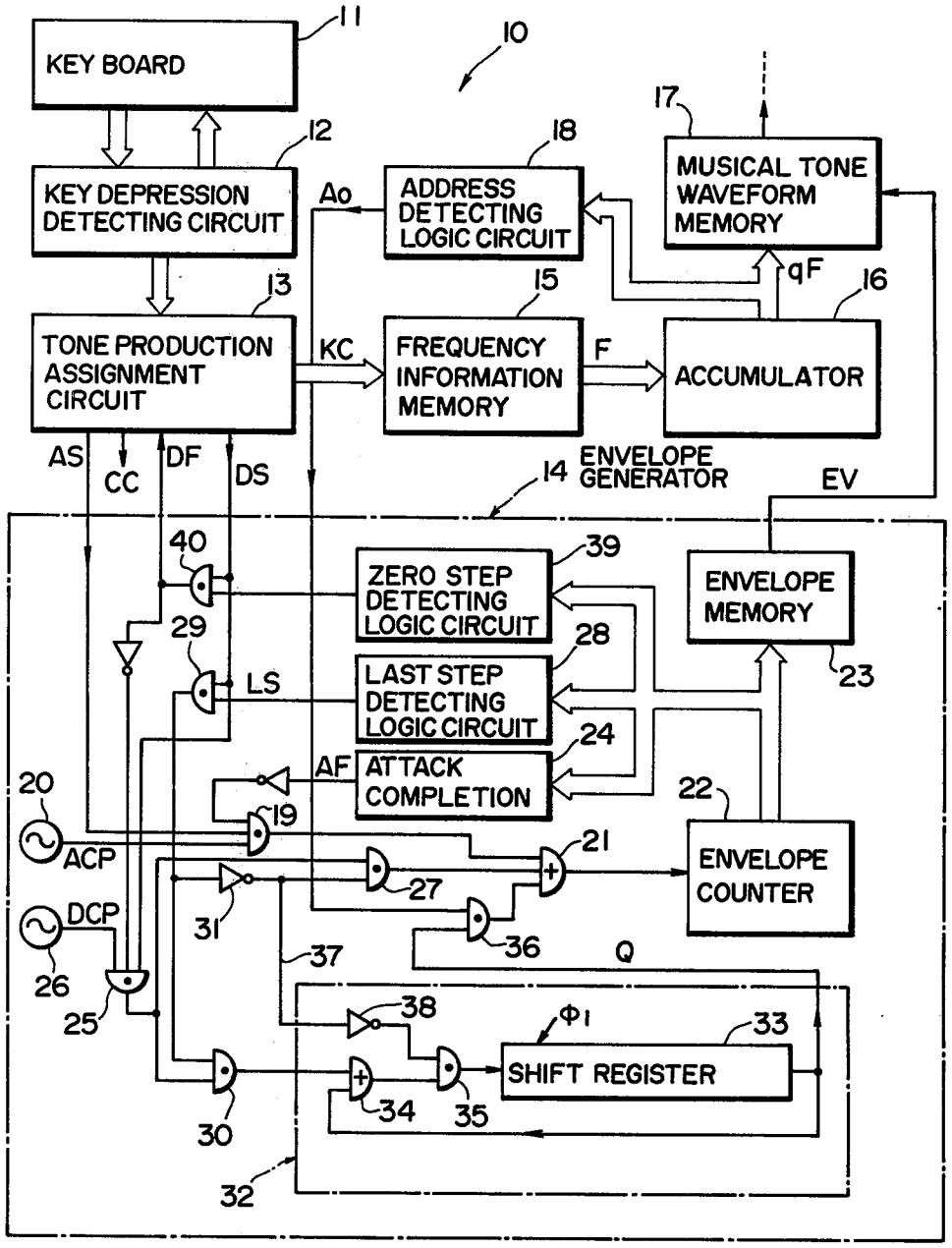
FIG. 2 is a block diagram showing one example of an electronic musical instrument according to this invention.

One example of an electronic musical instrument according to this invention, as shown in FIG. 2, comprises a keyboard 11, a key depression detecting circuit 12, a tone production assignment circuit 13, an envelope generator 14, a frequency information memory device 15, an accumulator 16, a musical tone waveform memory 17, and an address detecting logic-circuit 18.

In this musical instrument 10, the key depression detecting circuit 12 operates to detect the on-off operations of key switches provided for the keys in the keyboard 11 thereby to output information for discriminating the depressed key or keys. The tone production assignment circuit 13 operates to receive the information for discriminating the depressed keys and to assign each tone production of the key represented by the information to each of the channels corresponding to the maximal number of simultaneous tone productions (for instance twelve tone productions) of this musical instrument 10. The tone production assignment circuit 13 is provided with memory positions corresponding to the channels, and operates to store a key code KC representative of the key in a memory position corresponding to the channel to which the tone production of the key has been assigned, so that the key codes KC stored in the channels are outputted in a time division manner. Thus, when a plurality of keys in the keyboard 11 are depressed, the tone productions of the keys thus depressed are assigned to the respective channels, and the key codes KC representative of the assigned keys are stored respectively in the memory positions corresponding to the channels. Each memory position may be composed by a circulation type shift register.

In addition, the tone production assignment circuit 13 operates to produce in a time division manner in synchronization with the channel times, attack start signals (or key-on signals) AS representing that the tone productions of depressed keys should be effected in the respective channels to which the tone productions thereof have been assigned. Furthermore, the tone production assignment circuit 13 outputs decay start signals (or key-off signals) DS respresenting the fact that keys whose tone productions have been assigned to the respective channels have been released, in a time division manner in synchronization with the channel times. These signals AS and DS are utilized for amplitude envelope control (or tone production control) of musical tones. Furthermore, the tone production assigning circuit 13 receives from an envelope generator 14 a decay finish signal DF representing the fact that the tone production in a channel has been finished, and outputs a clear signal CC with the aid of this decay finish signal DF, which is employed to clear various memories with respect to the channel and to completely cancel the tone production assignment.

The key codes KC generated repeatedly in a time division manner in synchronization with the channel times are applied to the frequency information memory device 15.

The frequency information memory device 15 is made up of, for instance, a read only memory in which frequency information F corresponding to each of the musical tone frequencies of the keys is stored in advance. Upon application of a key code KC, the frequency information memory device 15 reads out the frequency information F corresponding to that key code. In the accumulator 16, the frequency information F thus read out are successively accumulated and the amplitude of a musical tone waveform is sampled at certain predetermined time intervals at sampling points determined by the output of the accumulator 16. Thus, the frequency information F is a digital value proportional to the musical tone frequency of a relevant key.

The value of frequency information F can be definitely determined if the value of musical tone frequency is defined with a certain constant sampling rate. For instance, assuming that when the value qF (where q=1, 2, 3 . . .) obtained by accumulating frequency information F in the accumulator 16 reaches 64 in the decimal notation, sampling of one musical tone waveform (or a tone source waveform) is completed, and in addition the time interval during which the accumulation is carried out, that is, the period of time during which all the channels make one circulation is 12 microseconds, then, the value of frequency information F is determined from the following equation:

$F=12\times 64\times f\times 10^{-6}$, where f is the frequency of a musical tone. This value F is stored in the memory device 15 with respect to the frequency f to be obtained.

The accumulator 16 is a counter in which frequency information F for the channels are accumulated at predetermined time intervals (at a rate of 12 microseconds separately according to the respective channel times), and the phase of a musical tone waveform to be read out is advanced as the accumulation value qF increases. When the accumulation value qF reaches 64 in the decimal notation, an overflow takes place so that the value is returned to zero (0), thus completing the reading operation of one waveform. In order to accumulate the data F of the channels in a time division manner, the accumulator 16 may be made up of a plural-bit adder and a 12-stage shift register corresponding to the number of channels.

In the musical tone waveform memory 17, a musical tone waveform (or a tone source waveform) is divided by a plurality of (for instance 64) sampling points so that the amplitude values at the sampling points are stored in the respective addresses in the order of time. The output, or value qF, of the accumulator 16 serves as a signal for specifying the address corresponding to an amplitude value at a musical tone waveform sampling point to be read out of the waveform memory 17.

Figure 1:
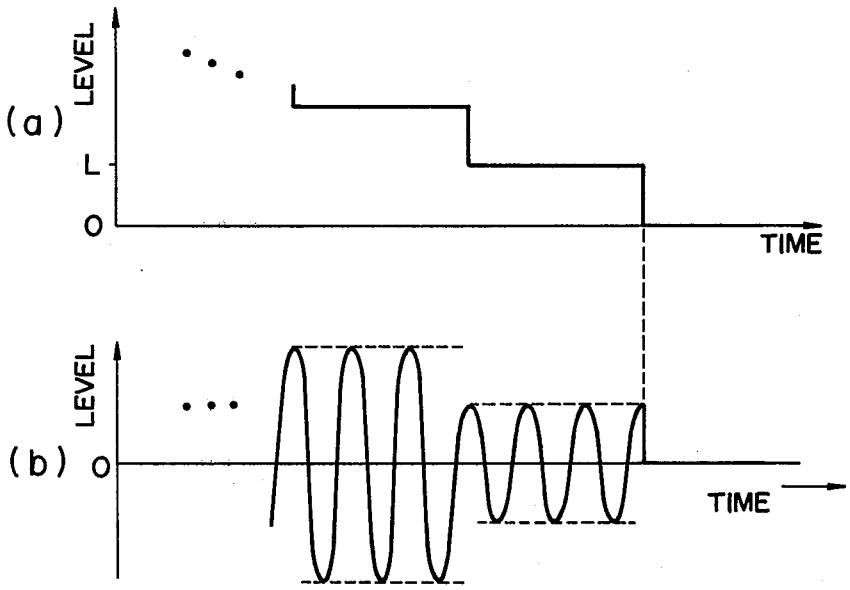
FIGS. 1(*a*) and 1(*b*) are graphical representations for a description of drawbacks accompanying a conventional envelope control.
Figure 3:
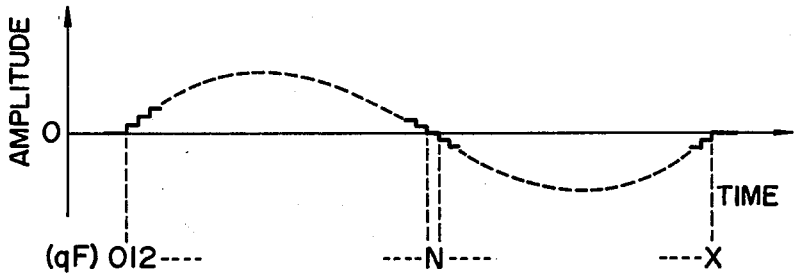
FIG. 3 is a graphical representation indicating one example of a musical tone waveform (or a tone source waveform) stored in a musical tone waveform memory, and relationships between the waveform thus stored and the addresses thereof.

FIG. 3 shows one example of the musical tone waveform stored in the waveform memory 17, and the relationships between the sequential sampling points of the musical tone waveform and the addresses represented by the accumulation values qF. In this example, the address increases from 0 to X in the order of 0, 1, 2, 3 . . . N . . . X. A musical tone waveform signal having a desired frequency is generated by repeating this increment adequate times.

The address detecting logic circuit 18 receives the output qF from the accumulator 16 to detect an address which corresponds to a phase in which the amplitude value of a musical tone waveform signal read out of the waveform memory 17 becomes 0 level. In the example shown in FIG. 3, the addresses 0 and N correspond to the phase of musical tone waveform where its amplitude is zero. Therefore, the logic of the address detecting logic 18 is so designed that when the value of the output qF of the accumulator 16 becomes to specify the address 0 or the address N, the level of the output $A^o$ of the address detecting logic 18 is raised to the level "1."

The operation of the envelope generator 14 will be described hereunder with respect to one channel only.

Figure 4:
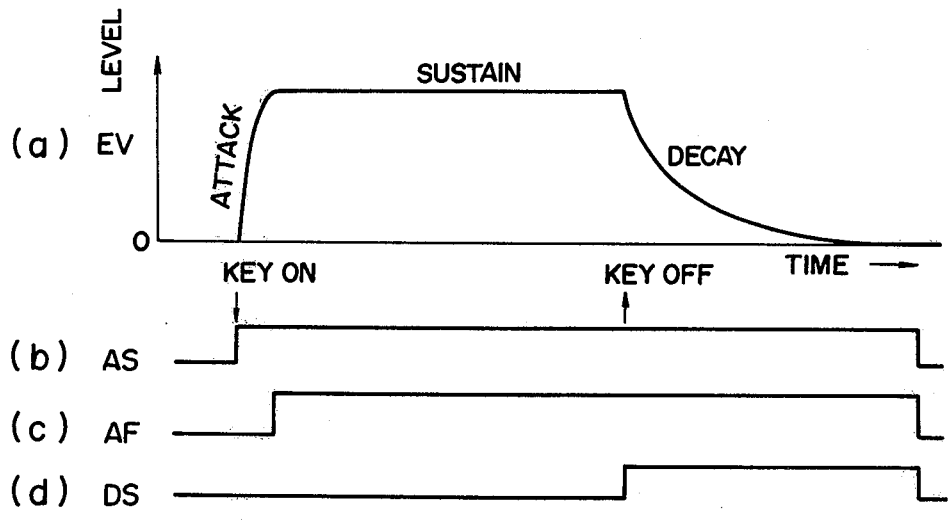
FIGS. 4(*a*) to 4(*d*) are timing charts for a description of the generating of a typical envelope waveform in an envelope generator shown in FIG. 2.

Upon depression of a key, the attack start signal AS is produced (FIG. 4(*b*)), and an AND circuit 19 is therefore enabled. As a result, an attack clock pulse ACP is applied from an attack clock pulse generating section 20 through the AND circuit 19 and an OR circuit 21 to an envelope counter 22. The envelope counter 22 operates to count the attack clock pulses ACP and to read to accordance with variation of count value the amplitude of an envelope waveform in an attack part out of an envelope memory 23 which stores in advance the amplitude envelope of a musical tone in a lapse of time (FIG. 4(*a*)). When reading the envelope waveform of the attack part is completed, an attack completion detecting logic circuit 24 produces an attack finish signal AF (FIG. 4(*c*)) according to the count value of the envelope counter 22, thereby to make the AND circuit 18 inoperable. As a result, the operation of the envelope counter 22 is suspended once, and the envelope waveform is brought to be in a sustain state in which the amplitude value thereof is maintained unchanged (FIG. 4(*a*)).

Upon release of the key, the decay start signal DS as shown in FIG. 4(*d*) is produced. This decay start signal DS is applied to an AND circuit 25, whereby a decay clock pulse DCP from a decay clock pulse generating section 26 is selected. The decay clock pulse DCP is applied through an AND circuit 27 and the OR circuit 21 to the envelope counter 22. The envelope counter 22 counts the decay lock pulses DCP to successively read the envelope waveform amplitude of a decay part out of the envelope memory 23 with variation in count value thereof (FIG. 4(*a*)).

Thus, an envelope waveform EV as in FIG. 4(*a*) for instance is produced by the envelope generator 14 in response to the key depression. In the waveform shown in FIG. 4(*a*) steps are omitted for simplification. In practice, the waveform is in the form of steps in correspondence to the variation in count value of the envelope counter 22. The length of one step corresponds to the period of the clock pulse ACP or DCP. In general, the period of the clock pulse ACP or DCP is much longer than the accumulation time interval (12 microseconds) at which the musical tone waveform reading address qF is obtained.

The envelope counter 22 is so formed that its counting operation is carried out in a time division manner with respect to each of the channels. For instance, the envelope counter 22 is made up of a plural-bit adder and a plural-bit shift register the number of stage of which is equal to the number of channels (the number being twelve in this embodiment). Accordingly, the envelope waveform EV is generated in a time division manner separately according to the channels.

The envelope waveform EV thus generated is applied to the musical tone waveform memory 17 so that the amplitude of the musical tone waveform signal read out of the musical tone waveform memory 17 is modulated in response to the amplitude level of the envelope waveform EV. In the case of this example, the levels at the musical tone waveform sequential sampling points are set by means of a resistance type voltage division circuit in the musical tone waveform memory 17, so that the amplitude voltage of the envelope waveform EV is divided in the resistance type voltage division circuit. For this purpose, the envelope waveform EV is applied to the musical tone waveform memory 17. However, it should be noted that this is not limiting. That is, the amplitude of the musical tone waveform signal may be modulated by controlling a voltage controlled amplifier or a scaler provided on the output side of the musical tone waveform memory 17 in accordance with the envelope waveform EV.

When the generation of the envelope waveform reaches the final step during the period in which the envelope of the decay part is being generated with the decay clock pulse DCP, a last step detecting logic circuit 28 is operated, as a result of which the level of a last step detecting signal LS is raised to the level "1." The last step detecting logic 28 operates to receive the count value signal of the envelope counter 22 to detect the fact that the count value has become a value corresponding to the last step. For instance, in the case where the count value for the last step is 63, it will output the last step detecting signal LS when the count value of the counter 22 reaches 63.

Figure 5:
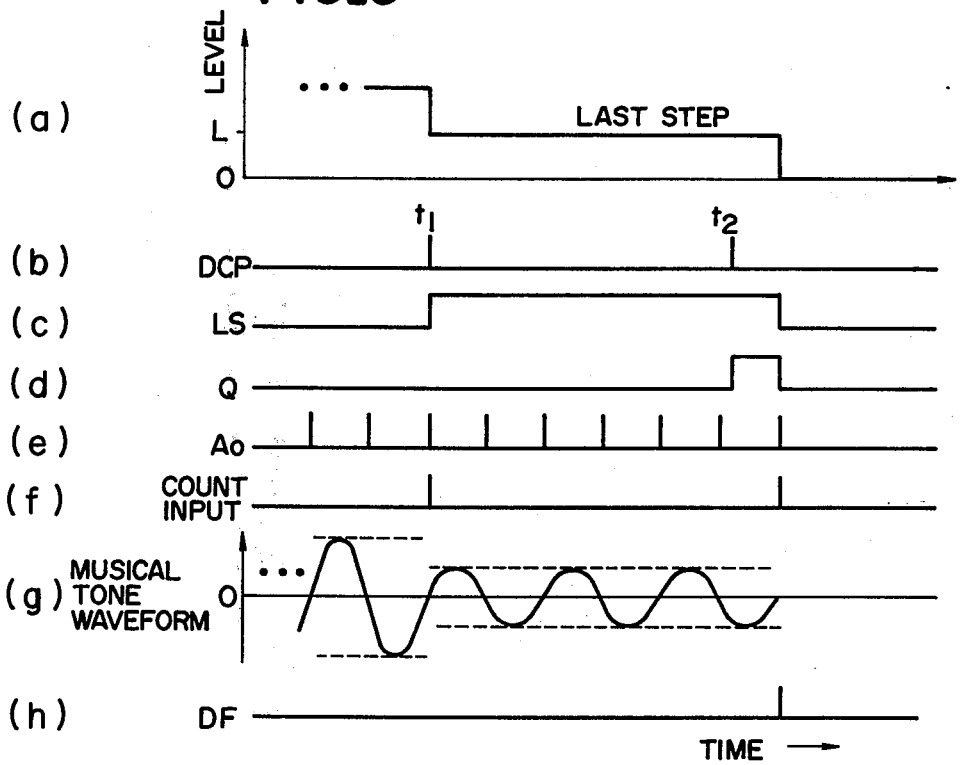
FIGS. 5(*a*) to 5(*h*) are also timing charts for a description of the operations of essential components of the electronic musical instrument shown in FIG. 2.

FIG. 5(*a*) is an enlarged diagram showing one example of the envelope waveform EV in the vicinity of the last step, with respect to one channel. When the decay clock pulse DCP at the time instant $t_1$ in FIG. 5(*b*) is applied to the counter 22, the last step takes place, and the amplitude value of the envelope waveform EV comes to the level L. An AND circuit 29 has been enabled by the decay start signal DS produced upon release of the key, so that the level of the output of the AND circuit 29 is raised to the level "1" by the last step detecting signal LS from a logic circuit 28 at the last step (FIG. 5(*c*)). By the output "1" of the AND circuit 29, an AND circuit 30 is enabled, while the AND circuit 27 is made inoperable through an inverter 31. Therefore, the decay clock pulse DCP which has been applied through the AND circuit 27 to the envelope counter 22 is no longer applied to the counter 22. Accordingly, when the decay clock pulse DCP is produced at the time instant $t_2$ in FIG. 5(*b*), the count value of the counter 22 is not changed, so that the level L for the last step is maintained.

On the other hand, since the AND circuit 30 is enabled, as was described above, the decay clock pulse DCP produced at the time instant $t_2$ operates to set a memory section 32 through the AND circuit 30 thus enabled. This memory section 32 is provided with a shift register 33 the number of stages of which is equal to the number of channels. In the memory section 32, the shift register 33 is shifted by a main clock pulse $\phi_1$ synchronizing with the channel times so that storage is effected in a time division manner separately according to the channels. A set signal is applied from the AND circuit 30 to the shift register 33 through an OR circuit 34 and an AND circuit 35. The output of the shift register 33 is fed back to the input side thereof through the OR circuit 34 and the AND circuit 35. Thus, the set signal is circulated and stored in the shift register in a time division manner separately according to the tone production channels.

The set output Q (FIG. 5(*d*)) of the memory section 32 set by the decay clock pulse DCP produced at the time instant $t_2$ is applied to one input of an AND circuit 36 to the other input of which the 0 level phase detecting signal A° (FIG. 5(*e*)) has been applied by the address detecting logic circuit 18 at the timing corresponding to the phase in which the level of the musical tone waveform amplitude becomes the level "0." Therefore, when the musical tone waveform sampling point having the amplitude value of "0" level is read from the musical tone waveform memory 17 with the output qF of the accumulator 16, the conditions for the AND circuit 36 are satisfied, and a count pulse is applied to the envelope counter 22 through the OR circuit 21 (FIG. 5(*f*)). Thus, the count value of the counter 22 is changed, and the last step is terminated. Upon termination of the last step, the amplitude level of the envelope waveform EV read out from the envelope memory 23 is lowered to the "0" level from the level L. Thus, the envelope waveform is ended. In this case, the musical tone waveform signal amplitude-modulated by the envelope waveform EV is at the phase corresponding to the amplitude of zero level. Therefore, as shown in FIG. 5(*g*), the time instant when the amplitude of the envelope waveform EV has the zero level coincides with the time instant when the amplitude of the musical tone waveform has the zero level, and therefore no click sound is caused.

Upon completion of the last step, the last step detecting signal LS becomes the "0" level, as a result of which the AND circuit 29 is made inoperable. The output "0" of the AND circuit 29 is inverted by the inverter 31, as a result of which a reset signal is applied to the memory section 32 through a line 37. The signal "1" applied to the memory section 32 is changed to the signal "0" through an inverter 38, as a result of which the AND circuit 35 is made inoperable. Therefore, the memory of the relevant channel in the shift register 33 is reset.

A zero step detecting logic 39 operates to receive the count value output of the envelope counter 22 and to detect the fact that the count value of the counter has reached a value corresponding to the "0" level of the envelope waveform. If it is assumed that the count value for the last step is 63 and when one pulse is added thereto the overflow takes place in the counter 22 as a result of which the count value becomes zero, the count value corresponding to the zero step is zero (0), and the zero step detecting logic 39 produces its output "1" when the count value of the counter 22 become zero. The output signal "1" of the zero step detecting logic circuit 39 is applied to an AND circuit 40 having been enabled by the decay start signal DS. The output "1" thus obtained from the AND circuit 40 is applied, as the decay finish signal DF, to the tone production assigning circuit 13. In the tone production assigning circuit 13, the clear signal CC is produced in response to the decay finish signal DF, as a result of which various memories and signals such as the key code KC, the attack start signal AS and the decay start signal DS concerning the relevant channel are cleared. Thus, the generation of the envelope waveform EV is ended, and the tone production (tone production assignment) is finished.

The memory section 32 is so designed as to carry out storage separately according to the channels in order that a plurality of tones can be produced; however, the memory section 32 may be made up of a flip-flop circuit if the envelope generator 14 is employed for controlling the envelope of a single tone.

The example of the electronic musical instrument shown in FIG. 2 is so designed that when the count value of the envelope counter 22 reaches a value for the last step, the count value is held, and when the musical tone waveform signal becomes the phase of the amplitude level zero, the count value of the counter 22 is shifted.

Figure 6:
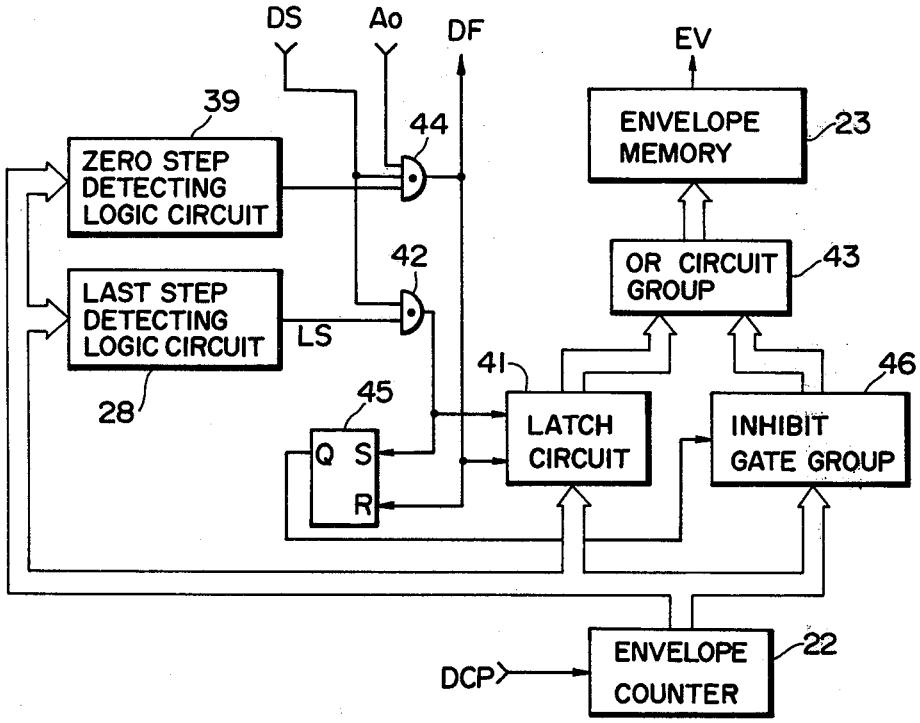
FIG. 6 is a block diagram illustrating another example of an envelope generator to be used in the electronic musical instrument according to the invention.

Another example of the envelope generator 14 according to the invention is shown in FIG. 6. In this example, the count value for the last step of the envelope counter 22 is stored in a latch circuit 41, and the envelope waveform level of the last step is read out of the envelope memory 23 in accordance with the count value thus stored.

Figure 7:
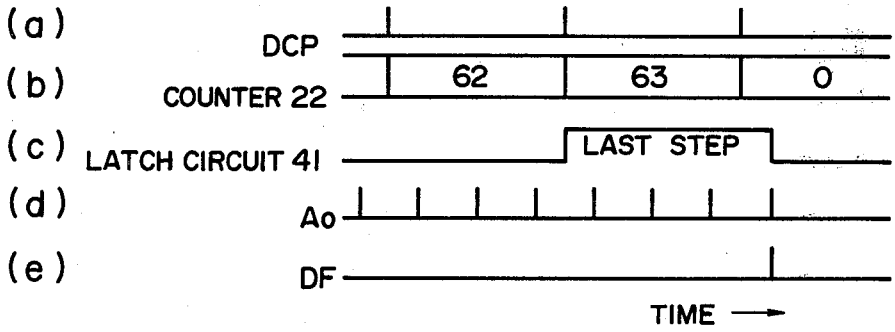
FIGS. 7(*a*) to 7(*e*) are timing charts for a description of the operation of the electronic musical instrument shown in FIG. 6.

FIG. 7(*a*) shows the decay clock pulse DCP applied to the envelope counter 22. FIG. 7(*b*) shows one example of the variation in count value of the counter 22. If it is assumed that the count value for the last step of the envelope waveform is 63, the last step detecting signal LS is provided by the last step detecting logic circuit 28 when the count value of the counter 22 reaches 63. An AND circuit 42 has been enabled by the decay start signal DS, and therefore the output level of the AND circuit 42 is raised to the level "1" in response to the last step detecting signal LS. The output "1" of the AND circuit 42 is applied to the latch circuit 41 thereby to allow the latch circuit 41 to store the count value of the counter 22 corresponding to the last step (FIG. 7(*c*)). The count value stored in the latch circuit 41 is applied through an OR circuit group 43 to the envelope memory 23 so as to read the envelope waveform level EV of the last step out of the envelope memory 23.

When the count value of the counter 22 reaches a value (for instance zero (0)) corresponding to the zero step in response to the application of the decay clock pulse DCP, the output level of the zero step detecting logic circuit 39 is raised to "1," and a 3-input AND circuit 44 is enabled since it has received the decay start signal DS from the assignment circuit 13 (FIG. 2). Even if the count value of the counter 22 is changed, the amplitude of the envelope waveform EV read out of the envelope memory 23 maintains the level of the last step because the count value corresponding to the last step is stored in the latch circuit 41.

Whenever the phase of the musical tone waveform signal becomes the phase having the amplitude value of zero level, the signal A° from the address detecting logic circuit 18 (FIG. 2) is output (FIG. 7(*d*). The 3-input AND circuit 44 produces its output "1" when the decay start signal DS and the output of the zero step detecting logic circuit 39 are at the level "1" respectively, and in addition the level of the signal A° raised to the level "1" in synchronization with the phase of the musical tone waveform signal having the amplitude leve zero. The output "1" of the AND circuit 44 serves to reset the latch circuit 41, and is applied, as the decay finish signal DF, to the tone production assignment circuit 13 (FIG. 2) (FIG. 7(*e*)). In this operation, the memory in the latch circuit 41 is reset. As a result, the amplitude level of the envelope waveform EV read out of the envelope memory 23 is lowered from the level of the last step to the zero level. Thus, the generation of the envelope is finished. Similarly as in the case of FIG. 5(*g*), the time instant when the amplitude of the musical tone waveform signal has the zero level coincidesa with the time instant when the level of the envelope waveform EV is lowered to the zero level.

A flip-flop circuit 45 is set by the output "1" of the AND circuit 42 and is reset by the output "1" of the AND circuit 44. This memory operation of the flip-flop circuit 45 is allowed to synchronize with the memory operation of the latch circuit 41. By the set output of the flip-flop circuit 45 an inhibit gate group 46 is operated, so as to inhibit the application of the count output of the envelope counter 22 to the OR circuit group 43 and the envelope memory 23 through the inhibit gate group 46. Thus, when the count value for the last step stored in the latch circuit is applied to the envelope memory 23, the application of the count value of the envelope counter 23 to the memory 23 is not allowed.

In the case of envelope control of plurality of tones, it is preferable that the latch circuit 41, OR circuit group 43, flip-flop circuit 45 and inhibit gate group 46 are made up of shift registers and gate groups for instance so that the count values for the channels can be stored and held in a time division manner.

As is appearent from the above description, according to the invention, the level of the musical tone amplitude controlling envelope waveform is made to be the zero level in coincidence with the phase time instant when the amplitude of the musical tone waveform signal has the zero level, as a result of which at the termination of the tone production, no click sound is generated.

What is claimed is:

1. An electronic musical instrument having circuitry in which an envelope waveform varying stepwise is generated and utilized to modulate the amplitude of a musical tone waveform signal, which comprises:

(a) detecting means, responsive to the phase of said musical tone waveform signal, for detecting when the amplitude of said tone waveform signal becomes a zero level; and (b) control means, cooperating with said detecting means and said circuitry, for bringing the amplitude of said stepwise generated envelope waveform to a zero level, and thereby ending generation of said envelope waveform, in synchronization with said tone waveform signal becoming a zero level as detecting by said detecting means.

2. An electronic musical instrument according to claim 1 in which said control means comprises a circuit which, when the amplitude of said envelope waveform has reached a "last" step immediately before the step at which said envelope waveform goes to zero level, holds said "last" step until the detection of said tone waveform signal zero level by said detecting means, thereby delaying the end of generation of said envelope waveform so as to coincide with the amplitude of said tone waveform signal becoming a zero level.

3. An electronic musical instrument according to claim 1 wherein said musical tone waveform signal is produced by:

a musical tone waveform memory storing amplitude values for a plurality of sample points of a musical tone waveform, and addressing means, connected to said musical tone waveform memory, for providing successive memory access addresses to effectuate readout of sample point amplitude values for successive phase angles of the stored musical waveform, and wherein said detecting means comprises:

address detecting logic circuitry, connected to said addressing means, for detecting each address provided by said address means which corresponds to an effective phase angle at which the read out sample point amplitude value is substantially equal to a zero level.

4. An electronic musical instrument according to claim 3 wherein said envelope waveform generating circuitry comprises:

an envelope memory storing a plurality of envelope levels which establish an envelope waveform, the envelope levels read from said memory being used to modulate the sample point amplitude values read out from said musical tone waveform memory, and envelope memory access circuitry, connected to said envelope memory and advanced at a selected clock rate, for providing successive access addresses to effectuate readout of successive stored envelope levels, and wherein said control means comprises:

last step detecting logic circuitry, connected to said envelope memory access circuitry, for recognizing when the provided access address corresponds to the envelope memory storage location at which the stored envelope level is the last level prior to a zero envelope level, and for causing continued access from said envelope memory of that last envelope level until occurrence of a signal from said address detecting logic circuitry indicating detection of a tone waveform memory access address corresponding to a phase angle at which the read out musical tone waveform sample point amplitude value is substantially equal to zero.

5. An electronic musical instrument according to claim 4 wherein said envelope memory access circuitry comprises an envelope counter, and wherein said last step detecting logic circuitry inhibits the stepping of said counter upon detection of said last level storage location access address until occurrence of said indicating signal from said address detecting logic circuitry.

6. An electronic musical instrument according to claim 4 wherein said envelope memory access circuitry includes a latch and wherein said last step detecting logic circuitry causes said latch to store said last level storage location access address and to continue to provide that stored address to said envelope memory until occurrence of said indicating signal from said address detecting logic circuitry.

7. An electronic musical instrument having means to eliminate clicks at the termination of tone production, comprising:

a musical tone waveform memory storing the amplitudes of a musical waveform at a plurality of sample points, tone waveform memory access means for providing successive addresses to said waveform memory to read out sample point amplitudes therefrom, each address corresponding to a successive phase angle of the generated musical tone waveform, an envelope memory storing levels at a plurality of sample points, said levels establishing an amplitude envelope, modulation means, cooperating with said waveform memory and said envelope memory, for modulating the musical waveform sample point amplitudes in accordance with the read out envelope levels, thereby to produce an envelope for the generated musical tone, envelope memory address means, response to a selected clock pulse signal, for reading out successive envelope levels from said envelope memory, last step detecting logic circuitry, responsive to the addresses provided by said envelope memory address means, for determining when the provided address corresponds to the envelope memory location storing the last step of the envelope prior to the envelope zero level, and maintenance means, cooperating with said last step detecting logic circuitry, for maintaining the address from said envelope memory address means at said value corresponding to said last step storage location until the address from said tone waveform memory access means is an address at which the amplitude read out from said musical tone waveform memory is zero.

* * * * *

Disclaimer 4,161,128.—*Shigeru Yamada* and *Eiichiro Aoki,* Hamamatsu, Japan. ELECTRONIC MUSICAL INSTRUMENT. Patent dated July 17, 1979. Disclaimer filed Nov. 16, 1982, by the assignee, *Nippon Gakki Seizo Kabushiki Kaisha.*

Hereby enters this disclaimer to claims 1, 2 and 3 of said patent.

[*Official Gazette January 4, 1983.*]